US010247452B2

(12) United States Patent
Tseng

(10) Patent No.: US 10,247,452 B2
(45) Date of Patent: Apr. 2, 2019

(54) DEVICE AND METHOD FOR SUPPORTING A PERSON

(71) Applicant: Yi-Ming Tseng, Palo Alto, CA (US)

(72) Inventor: Yi-Ming Tseng, Palo Alto, CA (US)

( * ) Notice: Subject to any disclaimer, the term of this patent is extended or adjusted under 35 U.S.C. 154(b) by 923 days.

(21) Appl. No.: 13/716,207

(22) Filed: Dec. 17, 2012

(65) Prior Publication Data

US 2014/0165608 A1 Jun. 19, 2014

(51) Int. Cl.

| | |
|---|---|
| ***F25B 21/02*** | (2006.01) |
| ***A47C 7/00*** | (2006.01) |
| ***A47C 7/02*** | (2006.01) |
| ***A47C 7/54*** | (2006.01) |
| ***A47C 7/62*** | (2006.01) |
| ***A47C 7/72*** | (2006.01) |
| ***A47C 7/74*** | (2006.01) |
| ***A47C 21/04*** | (2006.01) |

(52) U.S. Cl.

CPC ..... *F25B 21/02* (2013.01); *A47C 7/006* (2013.01); *A47C 7/02* (2013.01); *A47C 7/54* (2013.01); *A47C 7/62* (2013.01); *A47C 7/72* (2013.01); *A47C 7/725* (2013.01); *A47C 7/746* (2013.01); *A47C 21/044* (2013.01)

(58) Field of Classification Search

CPC ..... A47C 7/746; F25B 2321/0252; F25B 2321/0251; F25B 21/04; F25B 21/02

USPC ..... 62/3.2, 3.3, 3.61, 3.7; 165/276, 277

See application file for complete search history.

(56) References Cited

U.S. PATENT DOCUMENTS 2,621,616 A * 12/1952 Ames ..... A21B 3/13 126/20
3,037,065 A * 5/1962 Hockings ..... B23K 35/26 136/201
3,082,276 A * 3/1963 Corry ..... H01L 35/00 136/205
3,136,577 A * 6/1964 Richard ..... B60N 2/5692 219/202

(Continued)

FOREIGN PATENT DOCUMENTS

IE 20080084 A1 * 7/2010
IE 20080084 A1 * 7/2010

(Continued)

OTHER PUBLICATIONS

Body Support Surface—IE 20080084 A1 Patrick Noel Daly Jul. 7, 2010—Ireland.*

(Continued)

*Primary Examiner* — Cassey D Bauer
*Assistant Examiner* — Kirsten U Oswald

(57) ABSTRACT

A device for supporting a person may include a thermoelectric generator configured to receive heat provided from the person. The device may further include a first heat conductor overlapping the first thermoelectric generator and configured to conduct the heat to the thermoelectric generator. The device may further include a second heat conductor overlapping the first heat conductor and configured to conduct the heat to the first heat conductor. The first heat conductor may be disposed between the first thermoelectric generator and the second heat conductor. The second heat conductor may be softer than the first heat conductor. The device may further include a heat sink thermally connected to the first thermoelectric generator.

20 Claims, 2 Drawing Sheets

(56) References Cited

U.S. PATENT DOCUMENTS 3,167,159 A * 1/1965 Bovenkerk ..... E04B 1/803 52/404.1
3,179,199 A * 4/1965 Moran ..... B60K 1/00 180/65.6
3,302,703 A * 2/1967 Kelly ..... F25D 19/006 165/135
3,355,652 A * 11/1967 Lindenblad ..... H02J 7/00 307/48
3,399,717 A * 9/1968 Cline ..... F28D 15/06 165/104.26
3,463,224 A * 8/1969 Myers ..... B64G 1/50 165/185
3,518,091 A * 6/1970 Turner ..... A21B 5/02 426/19
3,648,469 A * 3/1972 Chapman ..... A47G 9/1036 165/135
4,217,628 A * 8/1980 Windom ..... G09F 13/04 362/131
4,327,046 A * 4/1982 Davis ..... A47C 27/086 264/102
4,413,857 A * 11/1983 Hayashi ..... A47C 7/74 297/180.11
4,463,214 A * 7/1984 Lowther ..... H01L 35/32 136/201
4,506,511 A * 3/1985 Cameto ..... A61G 10/02 62/3.61
4,777,802 A * 10/1988 Feher ..... A47G 9/0215 5/423
4,859,250 A * 8/1989 Buist ..... F25B 21/02 126/205
4,923,248 A * 5/1990 Feher ..... A47C 7/74 297/180.11
4,930,317 A * 6/1990 Klein ..... A61F 7/00 62/259.3
4,969,684 A * 11/1990 Zarotti ..... A47C 4/54 297/180.12
5,002,336 A * 3/1991 Feher ..... A47C 7/744 297/180.13
5,117,638 A * 6/1992 Feher ..... A47C 7/74 165/104.21
5,419,780 A * 5/1995 Suski ..... H01L 23/38 136/201
5,871,859 A * 2/1999 Parise ..... B01F 5/0614 320/150
5,966,763 A * 10/1999 Thomas ..... A47C 27/086 5/421
6,006,524 A * 12/1999 Park ..... A47C 21/044 62/3.2
6,010,528 A * 1/2000 Augustine ..... A61F 2/7843 297/452.21
6,062,641 A * 5/2000 Suzuki ..... A47C 7/74 297/180.1
6,066,902 A * 5/2000 Maurio ..... H01L 35/32 136/201
6,075,199 A 6/2000 Wong
6,232,543 B1 * 5/2001 Nagata ..... G04C 10/00 136/203
6,378,948 B1 * 4/2002 MacHer ..... A47C 7/425 297/180.12
7,320,223 B1 * 1/2008 Dabney ..... B60N 2/28 62/244
7,493,974 B1 * 2/2009 Boncodin ..... B60K 16/00 180/2.2
7,814,764 B1 * 10/2010 Heater ..... F24F 1/04 62/476
7,908,687 B2 * 3/2011 Ward ..... A47C 21/044 5/421
7,937,954 B2 * 5/2011 Kang ..... B60N 2/793 62/3.3
8,002,344 B2 * 8/2011 Abe ..... A47C 7/748 297/180.12
2002/0011071 A1 * 1/2002 Needham ..... B60H 1/00285 62/3.2
2004/0118555 A1 * 6/2004 Fristedt ..... B60H 1/00285 165/202
2005/0062323 A1 * 3/2005 Dicks ..... A47C 7/38 297/284.4
2005/0121064 A1 * 6/2005 Seo ..... H01L 23/38 136/200
2005/0253425 A1 * 11/2005 Asada ..... B60N 2/448 297/180.1
2006/0137358 A1 * 6/2006 Feher ..... B60N 2/5635 62/3.3
2006/0175877 A1 * 8/2006 Alionte ..... A47C 7/74 297/180.14
2007/0084220 A1 * 4/2007 Asada ..... F25B 21/04 62/3.61
2007/0204850 A1 * 9/2007 Pickard ..... A47J 36/26 126/262
2007/0226890 A1 * 10/2007 Pflueger ..... A61H 33/0095 4/541.1
2007/0234742 A1 * 10/2007 Aoki ..... B60H 1/00285 62/3.3
2007/0251242 A1 * 11/2007 Luo ..... F24F 5/0042 62/3.3
2008/0033518 A1 * 2/2008 Rousso ..... A61F 7/10 607/112
2008/0084095 A1 * 4/2008 Wolas ..... A47C 7/72 297/180.11
2008/0142494 A1 * 6/2008 Blake ..... B60N 2/5685 219/217
2008/0255637 A1 * 10/2008 Oishi ..... A61F 7/00 607/85
2009/0184829 A1 * 7/2009 Rivers, Jr. ..... G01K 1/14 340/584
2009/0288800 A1 * 11/2009 Kang ..... B60N 2/4686 165/42
2010/0025388 A1 * 2/2010 Ono ..... A47C 7/748 219/217
2010/0245090 A1 * 9/2010 Smith ..... A61B 5/1117 340/573.1
2011/0041246 A1 * 2/2011 Li ..... A47C 21/044 5/421
2011/0115635 A1 * 5/2011 Petrovski ..... A47C 21/044 340/584
2011/0289684 A1 * 12/2011 Parish ..... A47C 21/044 5/421
2011/0314837 A1 * 12/2011 Parish ..... A47C 21/044 62/3.4
2012/0110734 A1 * 5/2012 An ..... A47C 21/048 5/423
2013/0020845 A1 * 1/2013 Boomgarden ..... B64D 11/06 297/217.3
2013/0086923 A1 * 4/2013 Petrovski ..... H01L 35/00 62/3.61

FOREIGN PATENT DOCUMENTS

WO WO 2005076806 A2 * 8/2005 ..... A41D 13/0051
WO WO-2005076806 A2 * 8/2005 ..... A41D 13/0051

OTHER PUBLICATIONS

Building a Homemade Proofing Box—Kitchen Consumer-eGullet Forums Sep. 1, 2006.*
Seasoned Advice—Dec. 2010. https://cooking.stackexchange.com/questions/10310/how-warm-must-dough-be-in-order-to-rise.*
Building a Homemade Proofing Box—Kitchen Consumer-eGullet Forums Sep. 1, 2006 (Year: 2006).*
Seasoned Advice—Dec. 2010. https://cooking.stackexchange.com/questions/10310/how-warm-must-dough-be-in-order-to-rise (Year: 2010).*

(56) References Cited

OTHER PUBLICATIONS

Body Support Surface—IE 20080084 A1 Patrick Noel Daly Jul. 7, 2010—Ireland (Year: 2010).*

* cited by examiner

DEVICE AND METHOD FOR SUPPORTING A PERSON

BACKGROUND OF THE INVENTION

The present invention is related to a device for supporting a person.

For example, a chair may be used to support a person when the person works in an office or riding a transportation vehicle. As another example, a sofa may be used to support a person when the person watches a television show in a living room. As another example, a bed may be used to support a person when the person rests or sleeps in a bedroom. If the weather is hot, the office, the transportation vehicle, the living room, and/or the bedroom may be air-conditioned such that the user(s) of the bed, the sofa, and/or the chair may feel comfortable.

SUMMARY

One or more embodiments of the present invention may be related to a device for supporting a person. The device may include a thermoelectric generator configured to receive heat provided from the person. The device may further include a first heat conductor overlapping the first thermoelectric generator and configured to conduct the heat to the first thermoelectric generator. The device may further include a second heat conductor overlapping the first heat conductor and configured to conduct the heat to the first heat conductor. The first heat conductor may be disposed between the first thermoelectric generator and the second heat conductor. The second heat conductor may be softer than the first heat conductor. The device may further include a heat sink thermally connected to the first thermoelectric generator.

One or more embodiments of the present invention may be related to a device for supporting a person. The device may include a thermoelectric generator configured to receive a set of heat provided from the person. The device may further include a heat conductor overlapping the thermoelectric generator and configured to conduct the set of heat to the thermoelectric generator. The heat conductor may include a concave portion that is concave toward the thermoelectric generator for receiving the buttocks of the person. The set of heat may be provided from the rectum of the person. The device may further include a heat sink thermally connected to the thermoelectric generator.

One or more embodiments of the present invention may be related to a container for containing at least a person. The container may include a floor. The container may further include a power supply for powering at least one electrical device. The container may further include a thermoelectric generator overlapping the floor and electrically connected to the power supply. The thermoelectric generator may be configured to receive heat provided from the person for generating electricity and for providing the electricity to the power supply. The container may further include a heat conductor overlapping the thermoelectric generator and configured to conduct the heat to the thermoelectric generator. The container may further include a heat sink disposed between the floor and the thermoelectric generator for bearing at least a portion of a weight of the person, the heat sink being thermally connected to the thermoelectric generator.

One or more embodiments of the present invention may be related to a method of being supported. The method may include sitting on a seat module of a seating apparatus, the seat module including a heat conductor and a thermoelectric generator. The method may further include providing a portion of body heat from a rectum through the heat conductor to the thermoelectric generator. The method may further include using the portion of the body heat and the thermoelectric generator to generate electricity.

The above summary is related to only one or more of the many embodiments of the invention disclosed herein and is not intended to limit the scope of the invention, which is set forth in the claims herein. These and other features of the present invention will be described in more detail below in the detailed description of the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Although the terms first, second, third etc. may be used herein to describe various signals, elements, components, regions, layers, and/or sections, these signals, elements, components, regions, layers, and/or sections should not be limited by these terms. These terms may be used to distinguish one signal, element, component, region, layer, or section from another signal, region, layer or section. Thus, a first signal, element, component, region, layer, or section discussed below may be termed a second signal, element, component, region, layer, or section without departing from the teachings of the present invention. The description of an element as a "first" element may not require or imply the presence of a second element or other elements. The terms first, second, third, etc. may also be used herein to differentiate different categories of elements. For conciseness, the terms first, second, etc. may represent first-type (or first-category), second-type (or second-category), etc., respectively.

The features and advantages of the present invention may be better understood with reference to the figures and discussions that follow.

In the figures, the term "conductor" may represent "heat conductor" or "heat conducting element", for conciseness. A "conductor" illustrated in the figures may or may not be electrically conductive. In the figures, the term "insulator" may represent "heat insulator" or "heat insulating element", for conciseness. An "insulator" illustrated in the figures may or may not be electrically insulating.

Figure 1:
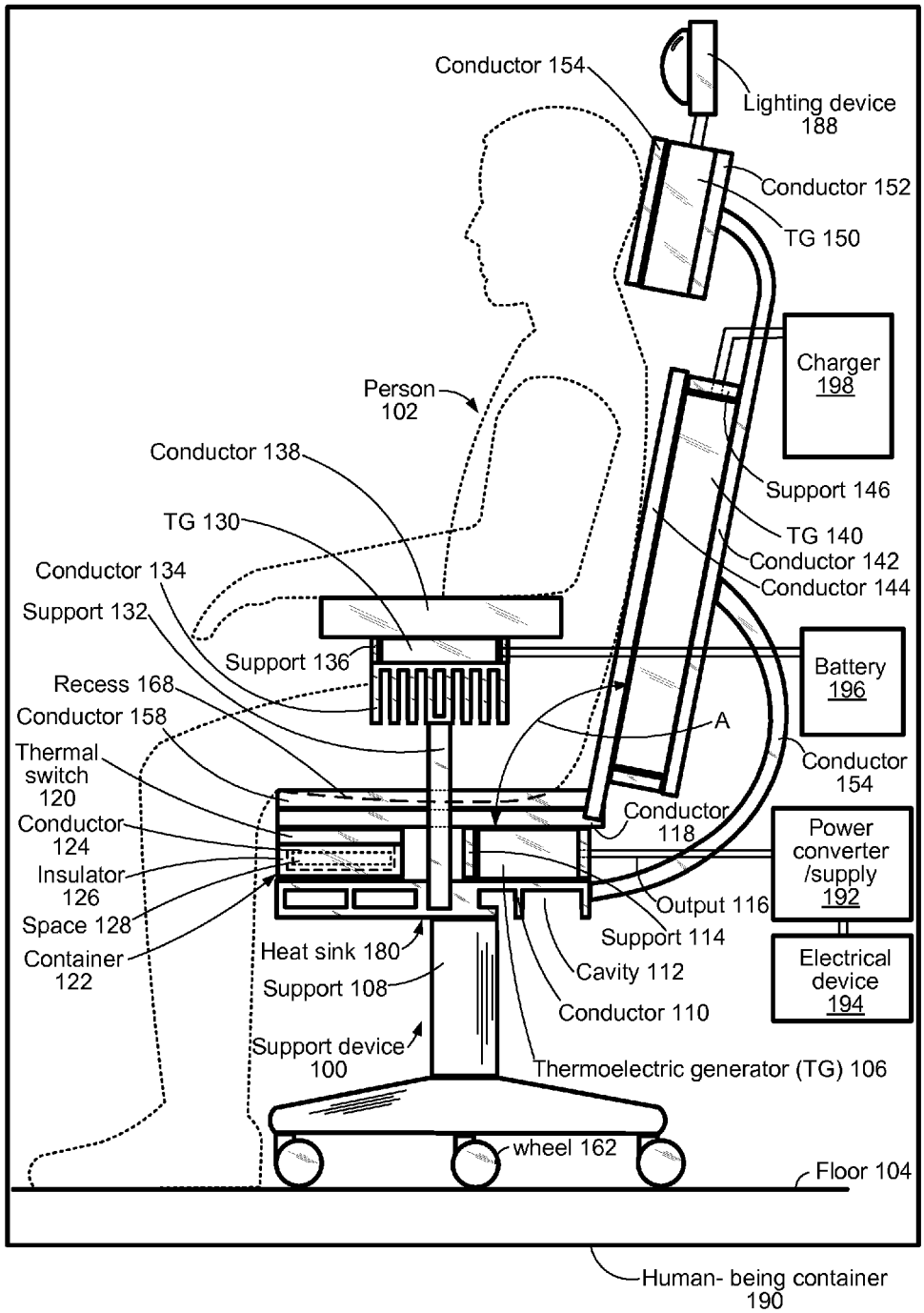
FIG. 1 shows a schematic representation illustrating a side view of at least a device for supporting (at least a body part of) a person in a human being container in accordance with one or more embodiments of the present invention.

FIG. 1 shows a schematic representation illustrating a side view of at least a device (e.g., a support device 100 and/or a seat module, a back module, an armrest module, and/or a headrest module of support device 100) for supporting (at least a body part of) a person 102 in accordance with one or more embodiments of the present invention. In one or more embodiments, support device 100 (or device 100 for conciseness) may a seating apparatus. For example, device 100 may be or may include one or more of a chair, a sofa, a seat in a transportation vehicle or craft, a theater seat, an auditorium seat, a concert hall seat, a toilet seat, etc. Device 100 may include one or more of a seat module, a back module, an armrest module, a headrest module, etc.

The seat module may include a thermoelectric generator 106 configured to receive a first set of heat provided from (e.g., the rectum and/or the legs of) person 102. Thermoelectric generator 106 may include a set of thermal couples (e.g., a set of semiconductors) for converting heat into electrical energy using, for example, Seebeck effect.

The seat module may further include a heat conductor 118 overlapping thermoelectric generator 106 and configured to conduct the first set of heat to thermoelectric generator 106. Heat conductor 118 may be made of or may include a substantially rigid heat conducting material, such as a thermally conductive plastic, a thermally conductive ceramic, or a metal. The rigidity of heat conductor 118 may contribute to structural robustness of device 100. In one or more embodiments, heat conductor 118 may be electrically insulating, for avoiding electrical shorting.

The seat module may further include a heat conductor 158 overlapping heat conductor 118 and configured to conduct the first set of heat, which may be provided from the rectum of person 102, to heat conductor 118. Heat conductor 118 may be disposed between thermoelectric generator 106 and heat conductor 158. For providing comfortable seating, heat conductor may 158 be softer and/or more flexible than heat conductor 118. In one or more embodiments, heat conductor 158 may be made of or may include one or more thermally conductive fabrics. In one or more embodiments, heat conductor 158 may include a recess portion 168 that is concave toward heat conductor 118, for receiving and/or accommodating the buttocks and/or the legs of person 102.

In one or more embodiments, heat conductor 118 and heat conductor 158 may represent two portions of a unitary or one-piece heat conductor having a concave portion (e.g., recess portion 168) that is concave toward thermoelectric generator 106 for receiving the buttocks of person 102. The unitary heat conductor may have substantially uniform flexibility or non-uniform flexibility. The unitary heat conductor may have substantially uniform heat conductivity or may have non-uniform heat conductivity.

The seat module may further include a heat sink 180 thermally connected to thermoelectric generator 106. Heat sink 180 may include one or more heat conductors, such as heat conductor 110, and/or one or more cavities, such as cavity 112, for dissipating heat. The one or more heat conductors of heat sink 180 may have one or more of a fin shape, a plate shape, a pipe shape, etc., with a suitable or optimized surface area for dissipating heat. The temperature of heat sink 180 may be substantially lower than the temperature of conductor 118, such that thermoelectric generator 106 may substantially effectively and/or efficiently generate electricity. Air conditioning or cold weather may contribute to the temperature difference.

The seat module may further include a support 114 configured to bear at least a first portion of a weight of person 102. Support 114 may be thermally insulating and may be disposed between heat sink 180 and heat conductor 118. Thermoelectric generator 106 may be disposed between at least two portions of support 114 and/or may be substantially surrounded by support 114. Support 114 may have higher material strength than thermoelectric generator 106 and/or thermal couple elements of thermoelectric generator 106, for protecting and reinforcing thermoelectric generator 106 against weight of person 102.

Device 100 may include a support 108. In one or more embodiments, support 108 and thermoelectric generator 106 may be substantially coaxial. In one or more embodiments, support 108 and thermoelectric generator 106 may not be coaxial, and support 108 may be configured to bear at least a second portion of the weight of person 102. Heat sink 180 may be disposed between support 114 and support 108 in a side view of device 100.

In one or more embodiments, support 108 may be thermally conducting (or thermally conductive) and may be thermally connected to heat sink 180. Support 108 may be configured to bear at least a weight of heat sink 180 and a weight of support 114. Heat sink 180 may be disposed between support 108 and conductor 118.

In one or more embodiments, a contact surface of heat conductor 118 may contact thermoelectric generator 106. Heat sink 180 may overlap each of support 114 and support 108 in a direction perpendicular to contact surface of heat conductor 118. At least a portion of the weight of person 102 may be exerted on support 108 through heat conductor 118, support 114, and heat sink 180.

In one or more embodiments, device 100 may include at least a wheel 162 for moving on a floor 104. Thermoelectric generator 106 may be disposed between wheel 162 and heat conductor 118 in a side view of device 100. Thermoelectric generator 106 and heat sink 106 may be maintained at a substantially constant height when device 100 moves on floor 104, such that perturbation to operation of thermoelectric generator 106 and heat sink 106 may be minimized.

The back module may include a thermoelectric generator 140 disposed at an obtuse angle A with respect to thermoelectric generator 106 according to an ergonomic design of the back module. Thermoelectric generator 140 may be configured to receive a second set of heat provided from (e.g., the back of) person 102. In one or more embodiments, device 100 may include a charger 198, such as an electronic device charger, and thermoelectric generator 140 may be configured to provide electricity to charger 198.

The back module may further include a heat conductor 144 configured to conduct the second set of heat to thermoelectric generator 140. In one or more embodiments, heat conductor 144 may include a plurality of heat conducting layers having different configurations, different rigidity, and/or different flexibility, e.g., analogous to heat conductor 118 and heat conductor 158, for providing structural robustness and ergonomic comfort.

The back module may further include a heat conductor 142 (or heat sink 142) thermally connected to thermoelectric generator 140 for dissipating heat and configured to bear at least a third portion of the weight of person 102 (e.g., related to the back of person 102). Thermoelectric generator 140 may be disposed between heat conductor 144 and heat conductor 142.

The back module may further include a support 146 disposed between heat conductor 144 and heat conductor 142 for reinforcing and/or protecting thermoelectric generator 140. In one or more embodiments, thermoelectric generator 140 may be disposed between at least two portions of support 146. In one or more embodiments, support 146 may substantially surround thermoelectric generator 140.

In one or more embodiments, heat conductor 142 (or heat sink 142) may be thermally connected to heat sink 180 through a heat conductor 154.

The headrest module may include a thermoelectric generator 150 disposed at an obtuse angle with respect to thermoelectric generator 106 according to an ergonomic design of the headrest module. Thermoelectric generator 150 may be configured to receive a third set of heat provided from (e.g., the head of) person 102. In one or more embodiments, device 100 may include a lighting device 188, such as a light-emitting diode (LED) lighting device, and thermoelectric generator 150 may be configured to provide electricity to lighting device 188.

The headrest module may further include a heat conductor 154 configured to conduct the third set of heat to thermoelectric generator 150. In one or more embodiments, heat conductor 154 may include a plurality of heat conducting layers having different configurations, different rigidity, and/or different flexibility, e.g., analogous to heat conductor 118 and heat conductor 158, for providing structural robustness and ergonomic comfort.

The headrest module may further include a heat conductor 152 (or heat sink 152) thermally connected to thermoelectric generator 150 for dissipating heat and configured to bear at least a fourth portion of the weight of person 102 (e.g., related to the head of person 102). Thermoelectric generator 150 may be disposed between heat conductor 154 and heat conductor 152.

The headrest module may further include a support disposed between heat conductor 144 and heat conductor 142 for reinforcing and/or protecting thermoelectric generator 150, wherein thermoelectric generator 150 may be disposed between at least two portions of the support and/or may be substantially surrounded by the support.

In one or more embodiments, heat conductor 152 (or heat sink 152) may be thermally connected to heat conductor 142 (or heat sink 142). In one or more embodiments, heat conductor 152 (or heat sink 152) may be thermally connected to heat sink 180 through heat conductor 142 (or heat sink 142).

The armrest module may include a thermoelectric generator 130 disposed at one or more obtuse angles with respect to thermoelectric generator 140 and/or thermoelectric generator 150 according to an ergonomic design of the armrest module. Thermoelectric generator 130 may be configured to receive a fourth set of heat provided from (e.g., the arm of) person 102. In one or more embodiments, device 100 may include a rechargeable battery 196, and thermoelectric generator 130 may be configured to provide electricity to charger 198.

The armrest module may further include a heat conductor 138 configured to conduct the fourth set of heat to thermoelectric generator 130. In one or more embodiments, heat conductor 138 may include a plurality of heat conducting layers having different configurations, different rigidity, and/or different flexibility, e.g., analogous to heat conductor 118 and heat conductor 158, for providing structural robustness and ergonomic comfort.

The armrest module may further include a heat conductor 134 (or heat sink 134) thermally connected to thermoelectric generator 130 for dissipating heat and configured to bear at least a fifth portion of the weight of person 102 (e.g., related to the arm of person 102). Thermoelectric generator 130 may be disposed between heat conductor 138 and heat conductor 134.

The armrest module may further include a support 136 disposed between heat conductor 138 and heat conductor 134 for reinforcing and/or protecting thermoelectric generator 130. In one or more embodiments, thermoelectric generator 130 may be disposed between at least two portions of support 136. In one or more embodiments, support 136 may substantially surround thermoelectric generator 130.

In one or more embodiments, heat conductor 134 (or heat sink 134) may be thermally connected to heat sink 180 through a support 132. In one or more embodiments, support 132 may include a heat conducting part and a heat insulating part, wherein the heat insulating part is disposed between the heat conducting part and at least one of heat conductor 118 and heat conductor 158, and wherein heat conductor 134 (or heat sink 134) may be heat connected to heat sink 180 through the heat conducting part of conduct support 132.

Device 100 may include a container 122. Device 100 may further include a thermal switch 120 configured to thermally connect container 122 to heat conductor 118 or thermally disconnect container 122 from the heat conductor 118 based on at least one of a temperature of heat conductor 118 and a temperature of container 120. In one or more embodiments, thermal switch 120 may be an adjustable thermal switch such that a threshold temperature for thermally connecting or thermally disconnecting container 122 and heat conductor 118 may be set by person 102 or a different user.

Container 122 may include a thermally insulating part 126 (or heat insulator 126) and a thermally conducting part 124 (or heat conductor 124). Thermally conducting part 124 may be surrounded by thermally insulating part 126 and may be (thermally) connected to thermal switch 120.

Container 122 may include an inner space 128 enclosed by at least one of thermally insulating part 126 and thermally conducting part 124. Person 102 may place an object inside inner space 128 for warming the object. A portion of the body heat of person 102 may be provided from the rectum and/or legs of person 102 through conductor 118, thermal switch 120, and thermally conducting part 124 of container 122 to the object. Person 102 may select and/or set a threshold temperature for thermal switch 120 to avoid over-warming or over-heating the object.

In one or more embodiments, the object may be a set of dough. Person 102 may place the dough in container 122 for leavening. As an example, when the temperature of container 122 reaches 90 degrees F., thermal switch 120 may disconnect container 122 from heat conductor 118, such that the dough may not be over-warmed and that yeast in the dough may not grow too fast.

In one or more embodiments, the object may include one or more eggs, such as chicken eggs, duck eggs, and/or turtle eggs. A suitable threshold temperature for the thermal switch 120 may be selected and/or configured according to the type of the eggs.

In one or more embodiments, both container 122 and thermoelectric generator 106 may be disposed between heat conductor 118 and heat sink 180. Both container 122 and thermoelectric generator 106 may receive body heat of person 102 from heat conductor 118. Both container 122 and thermoelectric generator 106 may by supported by heat sink 180. Thermally conducting part 124 of container 122 may be thermally insulated from heat sink 180 by thermally conducting part 124 of container 122. Container 122 may bear a portion of the weight of person 102. Container 122 may reinforce and/or protect thermoelectric generator 106.

In one or more embodiments, person 102 may sit on the seat module of device 100, may provide a first portion of body heat of person 102 from the rectum of person 102 (through a lower-body underwear and) through heat conductor 118 to thermoelectric generator 106, and may use the first portion of the body heat and thermoelectric generator 106 to generate electricity. The body heat of person 102 provided from the rectum per person 102 may be substantially higher than body heat that can be provided by many other parts of person 102. Advantageously, electricity generated by thermoelectric generator 106 may be maximized in view of other body heat sources of person 102 that are readily available for providing heat to thermoelectric generator 106.

In one or more embodiments, person 102 may place a set of dough inside the container and may provide a second portion of the body heat from the rectum of person 102 through heat conductor 118 to container 122, and therefore to the dough, for leavening the dough.

One or more embodiments of the invention may be related to a human-being container 190 (or container 190 for conciseness) for containing and/or supporting at least a person, such as person 102. In one or more embodiments, container 190 may be a building or a unit in a building. In one or more embodiments, container 190 may be a vehicle, a unit of a vehicle, a craft, or a unit of a craft.

Container 190 may include a floor 104. Container 190 may further include a power supply 192 for powering at least one electrical device (e.g., electrical device 194) and/or at least one electronic device. Power supply 192 may include a power converter for converting input electricity into output electricity that is suitable for use by the at least one electrical device and/or the at least one electronic device. Container 190 may further include thermoelectric generator 106 that overlaps floor 104 and is electrically connected to power supply 192. Thermoelectric generator 106 may be configured to receive heat provided from person 102 for generating electricity to provide the electricity through output 116 to power supply 192. Container 190 may further include heat conductor 118 that overlaps thermoelectric generator 106 and is configured to conduct the heat to thermoelectric generator 106. Container 190 may further include heat sink 180 that is disposed between floor 104 and thermoelectric generator 106 for bearing at least a portion of a weight of person 102, heat sink 180 being thermally connected to thermoelectric generator 106.

In one or more embodiments, container 190 may further include heat conductor 158 that overlaps heat conductor 118 and is configured to conduct the heat to heat conductor 118. Heat conductor 118 may be disposed between thermoelectric generator 106 and heat conductor 158. Heat conductor 158 may be softer than heat conductor 118.

In one or more embodiments, heat conductor 118 and heat conductor 158 may represent two portions of a unitary or one-piece heat conductor having a concave portion (e.g., recess portion 168) that is concave toward floor 104 and/or toward heat sink 180 for receiving the buttocks of person 102. The unitary heat conductor may have substantially uniform flexibility or non-uniform flexibility. The unitary heat conductor may have substantially uniform heat conductivity or may have non-uniform heat conductivity.

In one or more embodiments, thermoelectric generator 106 may be disposed between the concave portion (e.g., recess portion 168) and floor 104.

As can be appreciated from the discussion provided above, embodiments of the invention may advantageously generate electricity when supporting a person without substantially changing the person's behavior or habits. Electricity may be generated using the person's body heat without requiring the person to directly contact or wear additional devices. Electricity may be generated when people are seated, e.g., driving a car, riding a bus, attending a class, working in an office, watching a television show or a movie, enjoying a concert, etc.

Embodiments of may primarily utilize a person's rectal temperature, which is typically higher than temperatures of other parts of the person's body, to generate electricity. Advantageously, effectiveness of electricity generation may be maximized. Attempts to obtain heat from other parts of the person's body that have a temperature equivalent to the rectal temperature may require changes in the person's behavior or habits.

Figure 2:
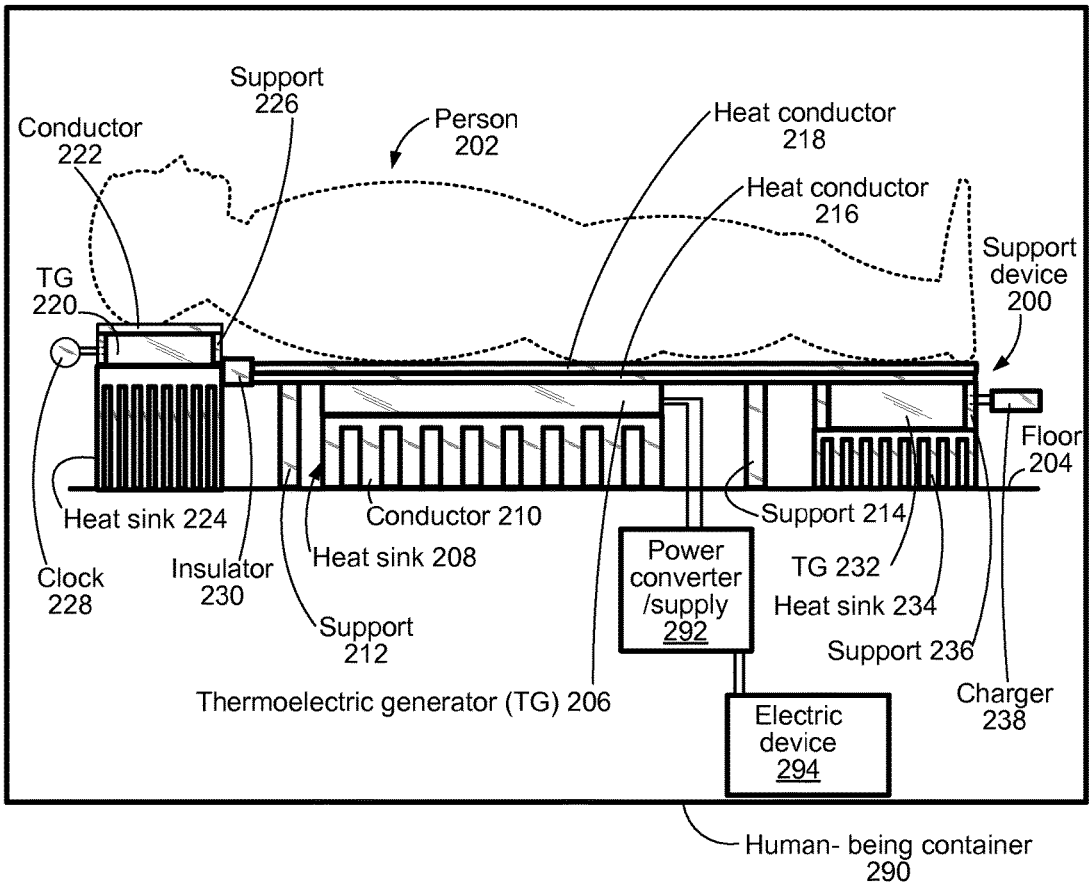
FIG. 2 shows a schematic representation illustrating a side view of at least a device for supporting (at least a body part of) a person in a human being container in accordance with one or more embodiments of the present invention.

FIG. 2 shows a schematic representation illustrating a side view of at least a device (e.g. a support device 200 and/or one or more modules of support device 200) for supporting (at least a body part) of a person 201 in accordance with one or more embodiments of the present invention. In one or more embodiments, support device 200 (or device 200 for conciseness) may be a sleep-facilitating and/or rest-facilitating apparatus. For example, device 200 may be or may include one or more of a bed, a lounger, a pillow, a headrest, a leg rest, an inversion table, etc.

Device 200 may include a thermoelectric generator 206 configured to receive a first set of heat provided from (e.g., the back and/or the buttocks of) person 202. Thermoelectric generator 206 may include a set of thermal couples (e.g., a set of semiconductors) for converting heat into electrical energy using, for example, Seebeck effect.

Device 200 may further include a heat conductor 216 overlapping thermoelectric generator 206 and configured to conduct the first set of heat to thermoelectric generator 206. Heat conductor 216 may be made of or may include a substantially rigid heat conducting material, such as a thermally conductive plastic, a thermally conductive ceramic, or a metal. The rigidity of heat conductor 216 may contribute to structural robustness of device 200. In one or more embodiments, heat conductor 216 may be electrically insulating, for avoiding electrical shorting.

Device 200 may further include a heat conductor 218 overlapping heat conductor 216 and configured to conduct the first set of heat, which may be provided from the back and/or the buttocks of person 202, to heat conductor 216. Heat conductor 216 may be disposed between thermoelectric generator 206 and heat conductor 218. For facilitating comfortable resting and/or sleeping, heat conductor may 218 be softer and/or more flexible than heat conductor 216. In one or more embodiments, heat conductor 218 may be made of or may include one or more thermally conductive fabrics.

In one or more embodiments, heat conductor 216 and heat conductor 218 may represent two portions of a unitary or one-piece heat conductor. The unitary heat conductor may have substantially uniform flexibility or non-uniform flexibility. The unitary heat conductor may have substantially uniform heat conductivity or may have non-uniform heat conductivity.

Device 200 may further include a heat sink 208 thermally connected to thermoelectric generator 206. Heat sink 208 may include one or more heat conductors, such as heat conductor 210, and/or one or more cavities for dissipating heat. The one or more heat conductors of heat sink 208 may have one or more of a fin shape, a plate shape, a pipe shape, etc., with a suitable or optimized surface area for dissipating heat. The temperature of heat sink 208 may be substantially lower than the temperature of conductor 216, such that thermoelectric generator 206 may substantially effectively and/or efficiently generate electricity. Air conditioning or cold weather may contribute to the temperature difference.

Device 200 may include a support 212 configured to bear at least a first portion of a weight of person 202. Support 212 may be thermally insulating and may be disposed between a floor 204 and heat conductor 216. Support 212 may have higher material strength than thermoelectric generator 206 and/or thermal couple elements of thermoelectric generator 206, for protecting and reinforcing thermoelectric generator 106 against weight of person 202.

Device 200 may include a support 214 configured to bear at least a second portion of the weight of person 202. Thermoelectric generator 206 may be disposed between support 212 and support 214 in a side view of device 200.

Device 200 may include a thermoelectric generator 220 (e.g., disposed in a headrest module or in a leg rest module) configured to receive second set of heat that is provided from (e.g., the head or the shanks of) person 202. In one or more embodiments, device 200 may include a clock 228, such as an electronic clock, and thermoelectric generator 220 may be configured to provide electricity to clock 228.

Device 200 may further include a heat conductor 222 configured to conduct the second set of heat to thermoelectric generator 220. In one or more embodiments, heat conductor 222 may include a plurality of heat conducting layers having different configurations, different rigidity, and/or different flexibility, e.g., analogous to heat conductor 216 and heat conductor 218, for providing structural robustness and ergonomic comfort.

Device 200 may further include a heat sink 224 thermally connected to thermoelectric generator 220 and configured to bear at least a second portion of the weight of person 202. Thermoelectric generator 220 may be disposed between heat conductor 222 and heat sink 224.

Device 200 may further include a heat insulator 230 disposed between heat conductor 216 and heat sink 224. Heat insulator 230 may thermally insulate heat sink 224 from heat conductor 216 and/or heat conductor 218.

Device 200 may further include a support 226 configured to bear at least the second portion of the weight of person 202. Support 226 may be thermally insulating. Support 226 may be disposed between heat sink 224 and heat conductor 222 for reinforcing and/or protecting thermoelectric generator 220. In one or more embodiments, thermoelectric generator 220 may be disposed between at least two portions of support 226. In one or more embodiments, support 226 may substantially surround thermoelectric generator 220.

Device 200 may include a thermoelectric generator 232 (e.g., disposed in a leg rest module or in a headrest module) configured to receive third set of heat that is provided from (e.g., the shanks or the head of) person 202. In one or more embodiments, device 200 may include a charger 238, such as an electronic device charger, and thermoelectric generator 232 may be configured to provide electricity to charger 238. Heat conductor 216 and heat conductor 218 may be configured to conduct the third set of heat to thermoelectric generator 232.

Device 200 may further include a heat sink 234 thermally connected to thermoelectric generator 232 and configured to bear at least a third portion of the weight of person 202. Thermoelectric generator 232 may be disposed between heat conductor 216 and heat sink 234.

Device 200 may further include a support 236 configured to bear at least the third portion of the weight of person 202. Support 236 may be thermally insulating. Support 236 may be disposed between heat sink 234 and heat conductor 216 for reinforcing and/or protecting thermoelectric generator 232. In one or more embodiments, thermoelectric generator 232 may be disposed between at least two portions of support 236. In one or more embodiments, support 236 may substantially surround thermoelectric generator 232.

One or more embodiments of the invention may be related to a human-being container 290 (or container 290 for conciseness) for containing and/or supporting at least a person, such as person 202. In one or more embodiments, container 290 may be a building or a unit in a building. In one or more embodiments, container 290 may be a vehicle, a unit of a vehicle, a craft, or a unit of a craft.

Container 190 may include a floor 204. Container 290 may further include a power supply 292 for powering at least one electrical device (e.g., electrical device 294) and/or at least one electronic device. Power supply 292 may include a power converter for converting input electricity into output electricity that is suitable for use by the at least one electrical device and/or the at least one electronic device. Container 290 may further include thermoelectric generator 206 that overlaps floor 204 and is electrically connected to power supply 292. Thermoelectric generator 206 may be configured to receive heat provided from person 202 for generating electricity to provide the electricity to power supply 292. Container 290 may further include heat conductor 216 that overlaps thermoelectric generator 206 and is configured to conduct the heat to thermoelectric generator 206. Container 290 may further include heat sink 208 that is disposed between floor 204 and thermoelectric generator 206 for bearing at least a portion of a weight of person 202, heat sink 208 being thermally connected to thermoelectric generator 206.

In one or more embodiments, container 290 may further include heat conductor 218 that overlaps heat conductor 216 and is configured to conduct the heat to heat conductor 216. Heat conductor 216 may be disposed between thermoelectric generator 206 and heat conductor 218. Heat conductor 218 may be softer than heat conductor 216.

In one or more embodiments, heat conductor 216 and heat conductor 218 may represent two portions of a unitary or one-piece heat conductor. The unitary heat conductor may have substantially uniform flexibility or non-uniform flexibility. The unitary heat conductor may have substantially uniform heat conductivity or may have non-uniform heat conductivity.

Device 200 and/or container 290 may enable electricity to be generated when person 202 is resting and/or sleeping without requiring substantial changes in the behavior or habits of person 202. Given that a substantially large surface of person 202 may contact heat conductor 218 and heat conductor 222, a substantial amount of heat may be received by thermal generator 206, thermal generator 232, and/or thermal generator 220. Advantageously, a substantial amount of electricity may be effectively generated. Given the heat transfer from person 202 to the heat conductors and/or to the heat sinks, user 202 may feel cool and comfortable with r reduced air-conditioning energy consumption.

As can be appreciated from the foregoing, embodiments of the invention may advantageously generate electricity when supporting a person without substantially changing the person's behavior or habits. Electricity may be generated using the person's body heat without requiring the person to directly contact or wear additional devices. Electricity may be generated when people are seated (e.g., driving a car, riding a bus, taking an airplane, attending a class, working in an office, watching a television show or a movie, enjoying a concert, etc.) and/or when people are resting and/or sleeping (e.g., at home, at a hotel, or on a cruise).

Embodiments of may primarily utilize a person's rectal temperature, which is typically higher than temperatures of other parts of the person's body, to generate electricity. Advantageously, effectiveness of electricity generation may be maximized. Attempts to obtain heat from other parts of the person's body that have a temperature equivalent to the rectal temperature may require changes in the person's behavior or habits.

In one or more embodiments, a substantially large contact surface of a person may provide heat to one or more thermoelectric generators. Advantageously, a substantial amount of electricity may be effectively generated.

In one or more embodiments, given the heat transfer from a person to one or more heat sinks, user 202 may feel cool and comfortable with reduced air-conditioning energy consumption.

While this invention has been described in terms of several embodiments, there are alterations, permutations, and equivalents, which fall within the scope of this invention. It should also be noted that there are many alternative ways of implementing the methods and apparatuses of the present invention. Furthermore, embodiments of the present invention may find utility in other applications. The abstract section may be provided herein for convenience and, due to word count limitation, may be accordingly written for reading convenience and should not be employed to limit the scope of the claims. It may be therefore intended that the following appended claims be interpreted as including all such alternations, permutations, and equivalents as fall within the true spirit and scope of the present invention.

What is claimed is:

1. A device for supporting a person, the device comprising:

a thermally conductive seat configured to support buttocks of the person;

a container overlapping the thermally conductive seat and comprising a thermally insulating part, a thermally conducting part, and an inner space, wherein the thermally conducting part is surrounded by the thermally insulating part, and wherein the inner space is enclosed by at least one of the thermally insulating part and the thermally conducting part; and a thermal switch overlapping each of the container and the thermally conductive seat, being positioned between the container and the thermally conductive seat, and configured to thermally disconnect the container from the thermally conductive seat based on at least one of a temperature of the container and a temperature of the thermally conductive seat.

2. The device of claim 1, wherein a first side of the thermal switch directly contacts the thermally conductive seat, and wherein a second side of the thermal switch directly contacts the thermally conducting part and is opposite the first side of the thermal switch.

3. The device of claim 2, wherein the second side of the thermal switch directly contacts the thermally insulating part.

4. The device of claim 1 comprising:

a heat sink, which directly contacts the container; and a thermoelectric generator, which directly contacts the heat sink.

5. The device of claim 4, wherein a side of the thermally conductive seat directly contacts both the thermal switch and the thermoelectric generator, and wherein a side of the heat sink directly contacts both the container and the thermoelectric generator.

6. The device of claim 1 comprising:

a lighting device; and a thermoelectric generator electrically connected to the lighting device and thermally connected to the thermally conductive seat.

7. The device of claim 1 comprising:

a heat sink overlapping each of the container and the thermally conductive seat, wherein the container is positioned between the heat sink and the thermally conductive seat;

a thermoelectric generator overlapping each of the heat sink and the thermally conductive seat and positioned between the heat sink and the thermally conductive seat; and a first support member, which is thermally insulating, is positioned between the container and the thermoelectric generator, is positioned between the heat sink and the thermally conductive seat, and directly contacts each of a first side of the heat sink and a first side of the thermally conductive seat.

8. The device of claim 7 comprising:

a second support member, which is positioned between the container and the thermoelectric generator in a side view of the device, overlaps a second side of the heat sink, and overlaps a second side of the thermally conductive seat.

9. The device of claim 8, wherein the second support member is positioned between the container and the first support member in the side view of the device and is spaced from each of the container and the first support member.

10. The device of claim 1, further comprising a thermoelectric generator, wherein the thermal switch directly contacts a first portion of a first side of the thermally conductive seat, wherein the thermoelectric generator directly contacts a second portion of the first side of the the thermally conductive seat, and wherein a second side of the thermally conductive seat is opposite the first side of the thermally conductive seat and is configured to receive the buttocks of the person.

11. The device of claim 1, wherein the thermal switch directly contacts each of the thermally conductive seat, the thermally conducting part, and the thermally insulating part.

12. A method of supporting a person, the method comprising:

using a thermally conductive seat to support buttocks of the person;

using the thermally conductive seat to receive a first set of heat from the person;

using the first set of heat received from the person to warm a set of dough when the set of dough is placed inside a container, wherein the thermally conductive seat overlaps the container; and using a thermal switch to thermally disconnect the container from the thermally conductive seat based on at least one of a temperature of the container and a temperature of the thermally conductive seat, wherein the thermally conductive seat overlaps the container.

13. The method of claim 12 comprising:

thermally disconnecting the container from the thermally conductive seat when the temperature of the container reaches 90 degrees F.

14. The method of claim 12 comprising:

placing an egg inside the container; and configuring a threshold temperature for the thermal switch according to a type of the egg.

15. The method of claim 12 comprising:

using the first set of heat to warm the dough when the person sits on the thermally conductive seat, and thermally disconnecting the container from the thermally conductive seat when the person sits on the thermally conductive seat.

16. The method of claim 12, wherein the thermally conductive seat is positioned between the person and the thermal switch and directly contacts the thermal switch when the container is thermally disconnected from the thermally conductive seat.

17. The method of claim 12 comprising:

using the thermally conductive seat to receive a second set of heat from the person;

using a thermoelectric generator and the second set of heat received from the person to generate a set of electrical energy; and providing the set of electrical energy to an electrical apparatus that is external to the thermally conductive seat.

18. The method of claim 17, wherein a side of the thermally conductive seat directly contacts both the thermal switch and the thermoelectric generator.

19. The method of claim 12, wherein a first side of the thermal switch directly contacts the thermally conductive seat, wherein a second side of the thermal switch directly contacts the container and is opposite the first side of the thermal switch.

20. The method of claim 12, wherein the container comprises a thermally insulating part, a thermally conducting part, and an inner space, wherein the set of dough is placed in the inner space, wherein the thermally conducting part is surrounded by the thermally insulating part, and wherein the inner space is enclosed by at least one of the thermally insulating part and the thermally conducting part.

* * * * *